US010317174B2

(12) United States Patent
Samson et al.

(10) Patent No.: US 10,317,174 B2
(45) Date of Patent: Jun. 11, 2019

(54) MODULAR SYSTEM FOR MOUNTING FIREARM ACCESSORIES AND METHOD FOR ATTACHING FIREARM ACCESSORY TO FIREARM

(71) Applicant: Samson Manufacturing Corp., Keene, NH (US)

(72) Inventors: Scott W. Samson, Spofford, NH (US); Jonathan Bernashe, Keene, NH (US)

(73) Assignee: Samson Manufacturing Corporation, Keene, NH (US)

( * ) Notice: Subject to any disclaimer, the term of this patent is extended or adjusted under 35 U.S.C. 154(b) by 0 days.

(21) Appl. No.: 15/915,865

(22) Filed: Mar. 8, 2018

(65) Prior Publication Data

US 2018/0259299 A1 Sep. 13, 2018

Related U.S. Application Data

(63) Continuation of application No. 14/760,295, filed as application No. PCT/US2014/011293 on Jan. 13, 2014, which is a continuation-in-part of application No. 13/740,831, filed on Jan. 14, 2013, now abandoned.

(51) Int. Cl.
*F41G 11/00* (2006.01)

(52) U.S. Cl.
CPC ..... *F41G 11/004* (2013.01); *Y10T 29/49828* (2015.01)

(58) Field of Classification Search
CPC ..... F41G 11/00; F41G 11/001; F41G 11/003; F41G 11/004
See application file for complete search history.

(56) References Cited

U.S. PATENT DOCUMENTS 3,877,166 A * 4/1975 Ward ..... F41G 11/003 42/127
5,865,560 A * 2/1999 Mercat ..... B62K 25/02 301/124.2
6,442,883 B1 * 9/2002 Waterman ..... F41G 11/003 42/124
6,773,172 B1 * 8/2004 Johnson ..... F16M 11/041 248/187.1
7,562,943 B2 * 7/2009 Kanehisa ..... B62K 25/02 301/124.2
7,823,316 B2 * 11/2010 Storch ..... F41G 11/003 42/127
7,886,476 B1 * 2/2011 Swan ..... F41C 27/00 403/374.5

(Continued)

*Primary Examiner* — Derrick R Morgan
(74) *Attorney, Agent, or Firm* — Burns & Levinson LLP; Bruce D. Jobse

(57) ABSTRACT

A modular system for mounting firearm accessories and a method for attaching a firearm accessory to a firearm are provided. In embodiment, the modular system includes a first mounting member capable of receiving a firearm accessory, and a second mounting member capable of combining with the first mounting member. A joining mechanism rotatable about an axis perpendicular to a longitudinal direction of the firearm, releasably joins the first mounting member with the second mounting member. In another embodiment, the modular system further includes an adjustment mechanism for adjusting engagement tightness of the mounting members with a mounting site to ensure more secure joining thereof.

10 Claims, 9 Drawing Sheets

(56) References Cited

U.S. PATENT DOCUMENTS 8,112,933 B1 * 2/2012 Swan ..... F41G 11/003 403/374.5
8,336,247 B2 * 12/2012 Haering ..... F41G 11/003 42/127
8,348,214 B2 * 1/2013 Vogt ..... F16M 11/041 248/187.1
8,397,421 B2 * 3/2013 Ding ..... F41G 11/003 42/124
8,438,965 B2 * 5/2013 Collin ..... F41G 11/003 89/125
8,707,606 B2 * 4/2014 Hoel ..... F41G 11/003 42/124
8,769,859 B2 * 7/2014 Li ..... F41G 11/003 42/124
9,194,659 B2 * 11/2015 Oglesby ..... F41G 11/003
10,132,596 B2 * 11/2018 Bartoszewicz ..... F41G 11/003
2010/0107467 A1 * 5/2010 Samson ..... F41G 11/003 42/127
2011/0067287 A1 * 3/2011 Collin ..... F41G 11/003 42/119
2011/0076095 A1 * 3/2011 Storch ..... F41C 27/00 403/322.4
2011/0146128 A1 * 6/2011 Haering ..... F41G 11/003 42/90
2011/0167703 A1 * 7/2011 Deros ..... F41G 11/003 42/90
2011/0247255 A1 * 10/2011 Ding ..... F41G 11/003 42/90
2011/0296731 A1 * 12/2011 Carlson ..... F41G 11/001 42/90
2012/0227304 A1 * 9/2012 Engelhardt ..... F41C 27/00 42/90
2013/0156495 A1 * 6/2013 Li ..... F41G 11/003 403/322.4
2014/0137457 A1 * 5/2014 Collin ..... F41G 11/003 42/90
2014/0196348 A1 * 7/2014 Samson ..... F41C 27/00 42/90
2015/0068095 A1 * 3/2015 Collin ..... F41G 11/003 42/90
2015/0362291 A1 * 12/2015 Samson ..... F41G 11/004 42/90
2016/0010949 A1 * 1/2016 Teetzel ..... F41G 1/35 42/115
2016/0187114 A1 * 6/2016 Burdine ..... F42B 23/005 102/371

* cited by examiner

MODULAR SYSTEM FOR MOUNTING FIREARM ACCESSORIES AND METHOD FOR ATTACHING FIREARM ACCESSORY TO FIREARM

CROSS-REFERENCE TO RELATED APPLICATIONS

This application is a continuation of U.S. application Ser. No. 14/760,295, filed on Jul. 10, 2015 and entitled "MODULAR SYSTEM FOR MOUNTING FIREARM ACCESSORIES AND METHOD FOR ATTACHING FIREARM ACCESSORY TO FIREARM", which is a U.S. national stage application under 35 U.S.C. 371 of co-pending International Application No. PCT/US2014/011293, filed on Jan. 13, 2014 and entitled "MODULAR SYSTEM FOR MOUNTING FIREARM ACCESSORIES AND METHOD FOR ATTACHING FIREARM ACCESSORY TO FIREARM", which in turn is a continuation-in-part of U.S. application Ser. No. 13/740,831, filed on Jan. 14, 2013 and entitled "MODULAR SYSTEM FOR MOUNTING FIREARM ACCESSORIES AND METHOD FOR ATTACHING FIREARM ACCESSORY TO FIREARM", all of which are incorporated by reference herein in their entirety for all purposes.

BACKGROUND

The present disclosure relates to a modular system for mounting firearm accessories and a method for attaching a firearm accessory to a firearm.

A broad range of commercially available firearm accessories are mountable onto a firearm to provide increased accuracy or broader functionality. Examples of these firearm accessories include telescopic devices, night vision devices, range finding and illuminating devices, laser devices, directed firing devices, etc. Firearm accessories are normally mounted to a firearm through a mounting device. A number of different types and configurations of mounting devices allows firearm accessories to be removed from and replaced on to the firearm. One challenge, however, is the time required to mount and dismount the firearm accessory to and from the firearm, particularly under realistic or combating conditions.

Accordingly, a need exists for a mounting arrangement that gives a firearm user the ability to easily and quickly deploy the desired firearm accessory in combat situations in a manner that is reliable and accurate with repeatable results.

SUMMARY

A modular system for mounting firearm accessories and a method for attaching a firearm accessory to a firearm are disclosed herein. In embodiment, the modular system includes a first mounting member capable of receiving a firearm accessory, and a second mounting member capable of combining with the first mounting member. A joining mechanism, rotatable about an axis perpendicular to a longitudinal direction of the firearm, releasably joins the first mounting member with the second mounting member. In another embodiment, the modular system further comprises an adjustment mechanism for adjusting engagement tightness of the mounting members with a mounting site to ensure more secure joining thereof.

In one aspect, the present disclosure provides a modular system for mounting firearm accessories. In one embodiment, the modular system includes a first mounting member capable of receiving a firearm accessory, a second mounting member capable of combining with first mounting member, and a joining mechanism for releasably combining first mounting member with second mounting member. The combination of the first and second mounting members and may be attached and securely fastened to a mounting site of a firearm. In one embodiment, the first mounting member has a channel and a stopping means in the channel. the second mounting member is capable of combining with the first mounting member, the second mounting member having a cavity. The joining mechanism is disposed in the channel of first mounting member and the cavity of the second mounting member for releasably combining the first mounting member and the second mounting member, the joining mechanism comprising a column, a guiding means on an end of the column and operably coupled to the stopping means in the channel, and a grip pivotably coupled to an opposing end of the column for rotating the joining mechanism.

In another aspect, the present disclosure provides a method for attaching a firearm accessory to a firearm. The method includes providing a modular system for mounting firearm accessories. The system includes a first mounting member capable of receiving a firearm accessory, a second mounting member capable of combining with the first mounting member, and a joining mechanism for releasably combining the first mounting member with the second mounting member. The method further includes attaching the first and second mounting members to a mounting site of a firearm, joining the first and second mounting members using the joining mechanism, and attaching a firearm accessory to the first mounting member of the modular system.

In one aspect, the present disclosure provides a modular system for mounting firearm accessories, comprising a first mounting member capable of receiving a firearm accessory, a second mounting member capable of engaging with the first mounting member, a joining mechanism for releasably engaging the first and second mounting members to a mounting site, wherein the joining mechanism is rotatable about an axis perpendicular to a longitudinal direction of a firearm, and an adjustment mechanism coupled to the joining mechanism for adjusting engagement tightness of the first and second mounting members with the mounting site. The fine tune mechanism comprises a sprocket wheel defining a plurality of teeth positions and a detent device coupled to one of the teeth positions. In one embodiment, an angle between neighboring teeth positions ranges from about 10 degrees to about 30 degrees. The sprocket wheel is engaged with the joining mechanism. The detent device is formed on a side of the first mounting member opposing the first mounting member, and is retractable into the first mounting member to allow rotation of the sprocket wheel.

In another aspect, the present disclosure provides a method for attaching a firearm accessory to a firearm. The method comprises A) providing a modular system for mounting firearm accessories, the system comprising: a first mounting member capable of receiving a firearm accessory; a second mounting member capable of engaging with the first mounting member; a joining mechanism for releasably engaging the first and second mounting members to a mounting site, wherein the joining mechanism is rotatable about an axis perpendicular to a longitudinal direction of a firearm; and a fine tune mechanism coupled to the joining mechanism for adjusting engagement tightness of the first and second mounting members with the mounting site; B) attaching the first and second mounting members to a mounting site of a firearm; and C) adjusting engagement tightness of the first and second mounting members with the mounting site using the fine tune mechanism; and D) joining the first and second mounting members by rotating the joining mechanism about an axis perpendicular to a longitudinal direction of a firearm. The method further comprises E) attaching a firearm accessory to the first mounting member of the modular system. In one embodiment, D) comprises rotating the joining mechanism for an angle of approximately 180 degrees. In one embodiment, C) comprises rotating a sprocket wheel of the fine tune mechanism to adjust the engagement tightness. In one embodiment, rotating the sprocket wheel comprises rotating the sprocket wheel stepwise for a predetermined angle in each step. In one embodiment, the predetermined angle ranges from about 10 degrees to about 30 degrees.

BRIEF DESCRIPTION OF THE DRAWINGS

The present disclosure is to be read in conjunction with the accompanying drawings, in which.

DETAILED DESCRIPTION

Disclosed herein is a modular accessory mount system that interfaces a firearm accessory with a mount site of a firearm. The modular accessory mount system allows the firearm accessory to be quickly and reliably attached and re-attached to the firearm.

Figure 1:
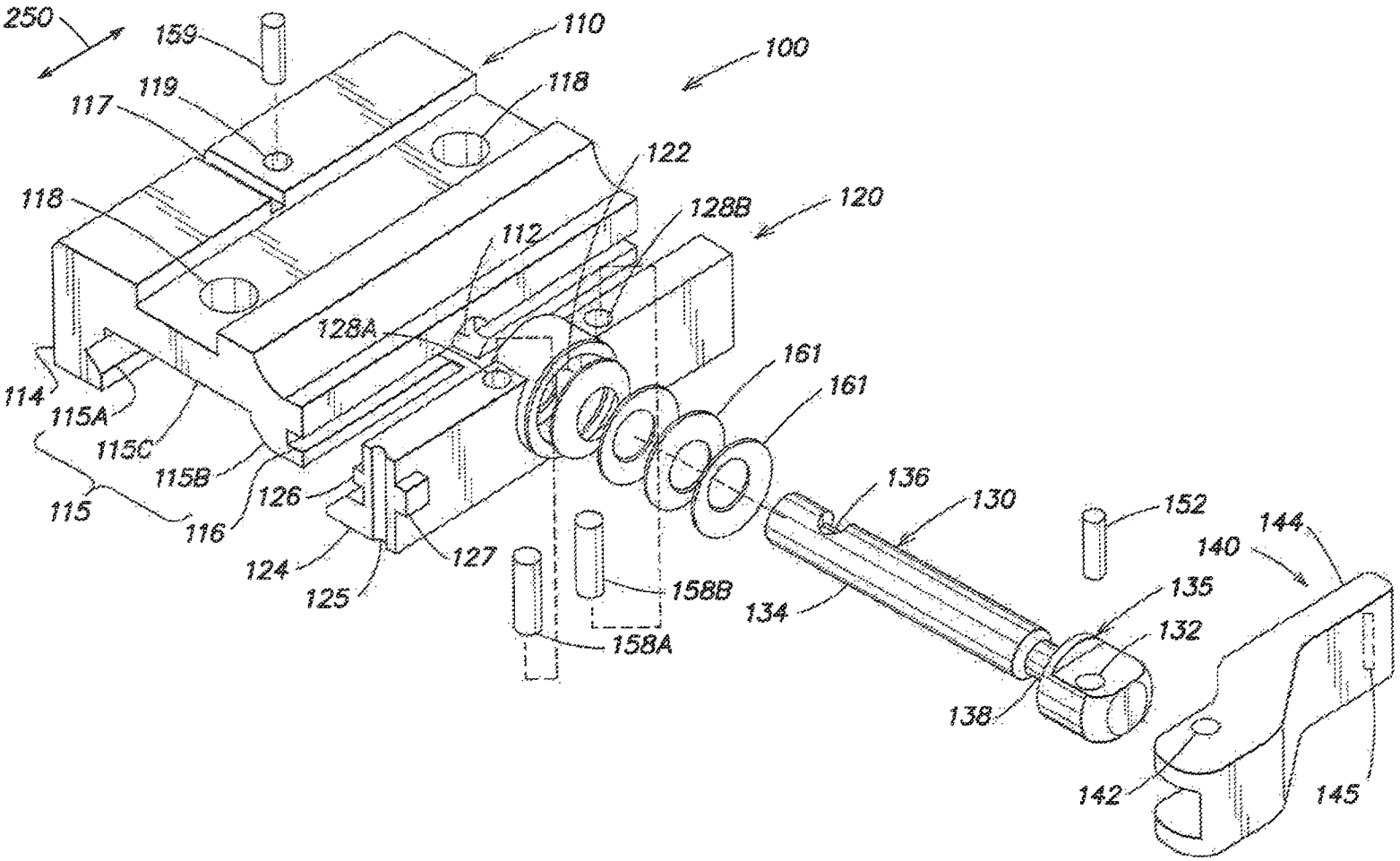
FIG. 1 is an exploded view of a modular system for mounting firearm accessories, in accordance with one embodiment of the present disclosure.
Figure 2:
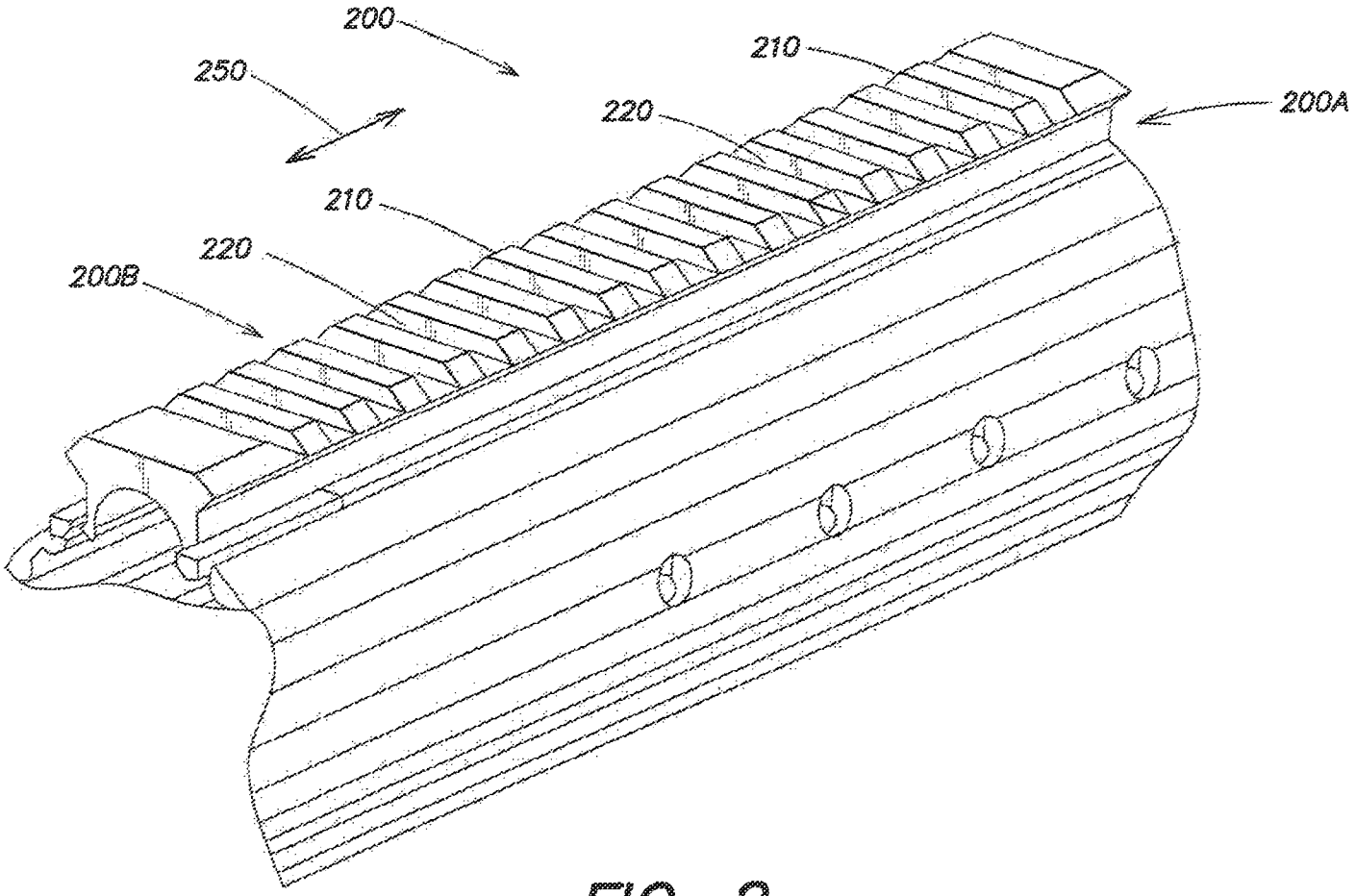
FIG. 2 (Prior Art)
FIG. 2 is a perspective view of an exemplary mount site of a firearm, on which a modular system of the present disclosure can be secured fastened.
Figure 3:
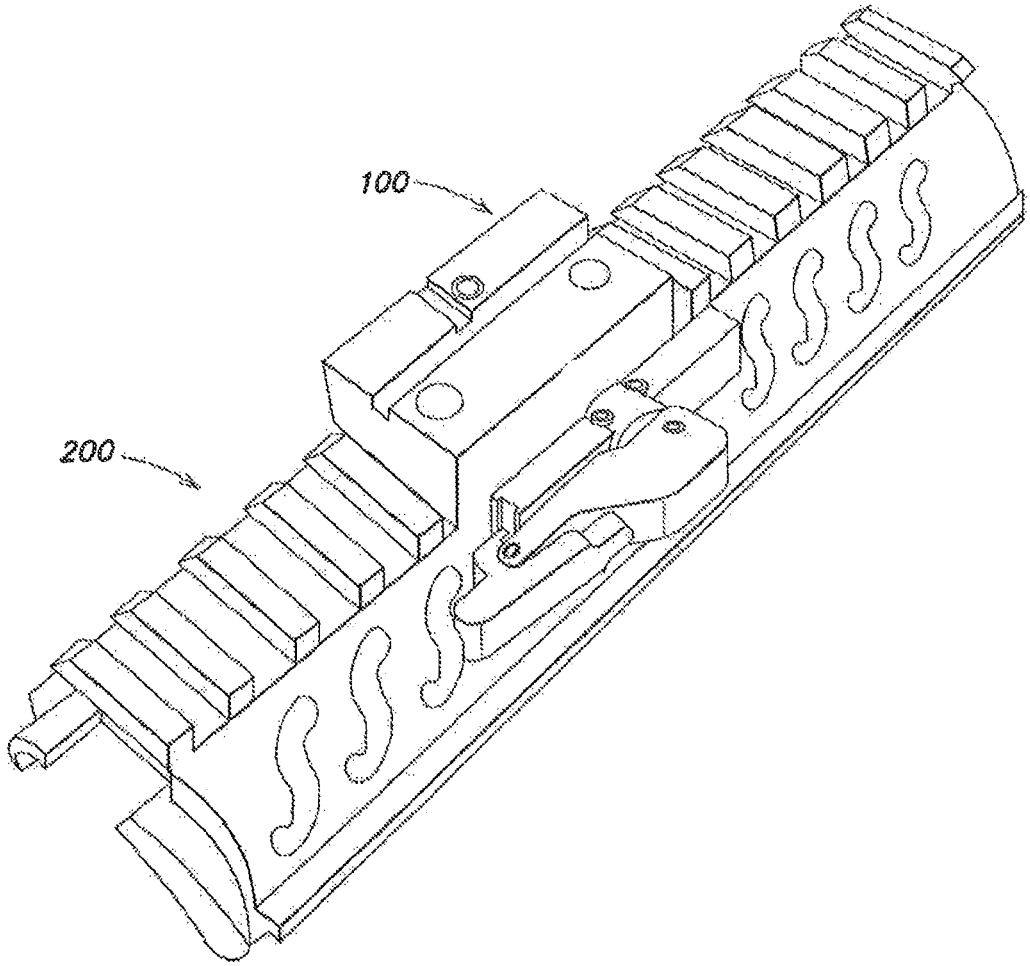
FIG. 3 is a perspective view of a modular system in combination with a mounting site, in accordance with one embodiment of the present disclosure.

Referring to both FIGS. 1 and 2, in one embodiment, a modular system 100 for mounting firearm accessories includes a first mounting member 110 capable of receiving a firearm accessory, a second mounting member 120 capable of combining with first mounting member 110, and a joining mechanism 130 for releasably combining first mounting member 110 with second mounting member 120. The combination of the first and second mounting members 110 and 120 may be attached and securely fastened to a mounting site 200 of a firearm, as shown in FIG. 2. Mounting site 200 may be a dovetail rail 210 including a plurality of equally spaced sockets 220. FIG. 3 illustrates a perspective view of modular system 100 in combination with mounting site 200, in accordance with one embodiment of the present disclosure.

First mounting member 110 includes a first mounting mechanism 115 at a bottom portion thereof. First mounting mechanism 115 may be constituted by a first receiving groove 115A formed on a leg 114 of first mounting member 110, a first portion of a second receiving groove 115B, and a substantially flat surface 115C. First mounting mechanism 115 may be shaped to complimentarily engage with a substantial portion of mounting site 200 of a firearm. First mounting member 110 further includes a channel 112 formed at the bottom portion thereof. Channel 112 provides space along a transversal direction of the firearm, the transversal direction being perpendicular to a longitudinal direction 250, so as to accommodate joining mechanism 130 therein. In one embodiment, channel 112 may be formed to expose joining mechanism 130 below surface 115C, so as to allow joining mechanism 130 to be engaged with socket 220 of dovetail rail 200 when modular system 100 is attached to mounting site 200.

First mounting member 110 may include recesses 118 at an upper portion thereof for receiving a firearm accessory. In one embodiment, recesses 118 may be through holes which may form openings on surface 115C. First mounting member 110 may further include a ditch 117, which may allow a firearm accessory to properly align with modular system 100. Further, first mounting member 110 may include an aperture 119 for receiving a post 159 therein. In one embodiment, post 159 may have a threaded surface similar to that of a screw. In one embodiment, post 159 may protrude surface 115C, so as to form a stopping means to be described further below.

Second mounting member 120 includes a second mounting mechanism 124 at a bottom portion thereof. Second mounting mechanism 124 may be shaped to complimentarily engage with a remaining portion of mounting site 200. In this embodiment, second mounting mechanism 124 may constitute a second portion of a second receiving groove 115B. When first mounting member 110 is coupled with second mounting member 120, the combination of the first portion of second receiving groove 115B on first mounting member 110 and the second portion of second receiving groove 115B on second mounting member 120 forms second receiving groove 115B. When modular system 100 is attached to mounting site 200, first and second receiving grooves 115A and 1158 are respectively and securely engaged with sides 200A and 200B of mounting site 200 of the firearm.

Second mounting member 120 is combinable with first mounting member 110 at a first side of first mounting member 110. When mounting system 100 is attached to a firearm, the first side of first mounting member 110 may be substantially parallel to longitudinal direction 250 of the firearm. First mounting member 110 includes a first engagement mechanism 116 at the first side. Second mounting member 120 includes a second engagement mechanism 126 at an upper portion thereof. First engagement mechanism 116 may be complimentarily coupled to second engagement mechanism 126. In this embodiment, first engagement mechanism 116 is a trench, while second engagement mechanism 126 is a ridge. In an alternative embodiment, first engagement mechanism 116 may be a ridge, while second engagement mechanism 126 may be a ridge. It is appreciated that, in other embodiments, first and second engagement mechanisms 116 and 126 may be of any shapes capable of complimentarily engaged with each other.

Second mounting member 120 further includes a cavity 122 formed at a central portion thereof. When first mounting member 110 is coupled with second mounting member, cavity 122 aligns with channel 112 so as to accommodate joining member 130 therein. In addition, second mounting member 120 includes apertures 128A and 128B for respectively receiving posts 158A and 158B therein. When posts 158A and 158B are inserted in apertures 128A and 128B, central portions of posts 158A and 158B are exposed in cavity 122, which effectively narrows the space in cavity 122.

Referring again to FIG. 1, in this embodiment, joining mechanism 130 includes a column 134 having a substantially cylindrical portion. Joining mechanism 130 may include a guiding means 136 proximate an end of the column. Joining mechanism 130 may further include a grip 140 proximate an opposing end of column 134. Joining mechanism 130 operably couples first and second mounting members 110 and 120 through insertion of joining mechanism 130 in channel 112 and cavity 122. In one embodiment, modular system 100 may include one or more washers 161 disposed proximate cavity 122, with joining mechanism 130 inserted therethrough, for providing elastic force and supporting joining mechanism 130. In another embodiment, washers 161 or other elastic means may be disposed between channel 112 and cavity 122, with joining mechanism 130 inserted therethrough, to provide restoration force when releasing second mounting member 120 from being securely coupled with first mounting member 110. Grip 140 includes an aperture 142 and a handle 144. In one embodiment, grip 140 is pivotably coupled to a connection head 135 at an end of column 130 opposing guiding means 136, by insertion of a pin 152 through aperture 142 of grip 140 and a through hole 132 at connection head 135.

Joining mechanism 130 may further include a neck portion 138 between guiding means 136 and connection head 135, and proximate connection head 135. Neck portion 138 has a diameter less than that of the cylinder portion of column 134. When combining first and second mounting members 110 and 120, joining member 130 may be inserted through cavity 122 and channel 112, with neck portion 138 aligning with cavity 122 and guiding means 136 aligning with aperture 119. Subsequently, post 159 may be inserted in aperture 119 and protrudes surface 115C to form a stopping means, which may be engaged with guiding means 136. Further, posts 158A and 158B may be inserted through apertures 128A and 128B, such that the exposed portions of posts 158A and 158B in cavity 122 may align with neck portion 138. By rotating joining means 130, force may be transferred to first and second mounting members 110 and 120 through posts 158A, 158B, and 159 to either bring first and second mounting members 110 and 120 closer to each other, or push first and second mounting members 110 and 120 apart from each other. As a result, first and second mounting members 110 and 120 may be securely engaged with or released from each other.

In one embodiment, guiding means 130 may include a notch having a helical shape. In one embodiment, the helical shape extends on cylindrical portion 134 for an azimuth of about 180 degrees and a height of about 2-3 mm. Guiding means 130 may be engaged with the stopping means formed by the protrusion of post 159 in channel 112. Joining mechanism 130 may securely fasten first and second mounting members 110 and 120 through engagement of guiding means 136 and the stopping means. In one embodiment, guiding means 136 and the stopping means are engaged through rotation of joining mechanism 130 via grip 140. In one embodiment, guiding means 136 and the stopping means may be securely engaged by rotating joining mechanism 130 for an angle of the azimuth of the helical notch, such as about 180 degrees. It is to be understood that, in alternative embodiments, the azimuth of the helical notch may be an angle between about 90 to 180 degrees.

Referring again to FIG. 1, in one embodiment, grip 140 may include a locking member 145 at an end of grip 140 proximate handle 144, and second mounting member 120 may include a blocking member 125 at an end of second mounting member 120. In this embodiment, when joining member 130 is rotated to an angle sufficient to securely fasten first and second mounting members 110 and 120, locking member 145 may be aligned with blocking member 125. By exerting a force at handle 144 to pivotally rotate grip 140 about pin 152, locking member 145 may be moved towards blocking member 125 and subsequently engaged with blocking member 125, so as to maintain handle 144 at a stationary position.

Figure 4:
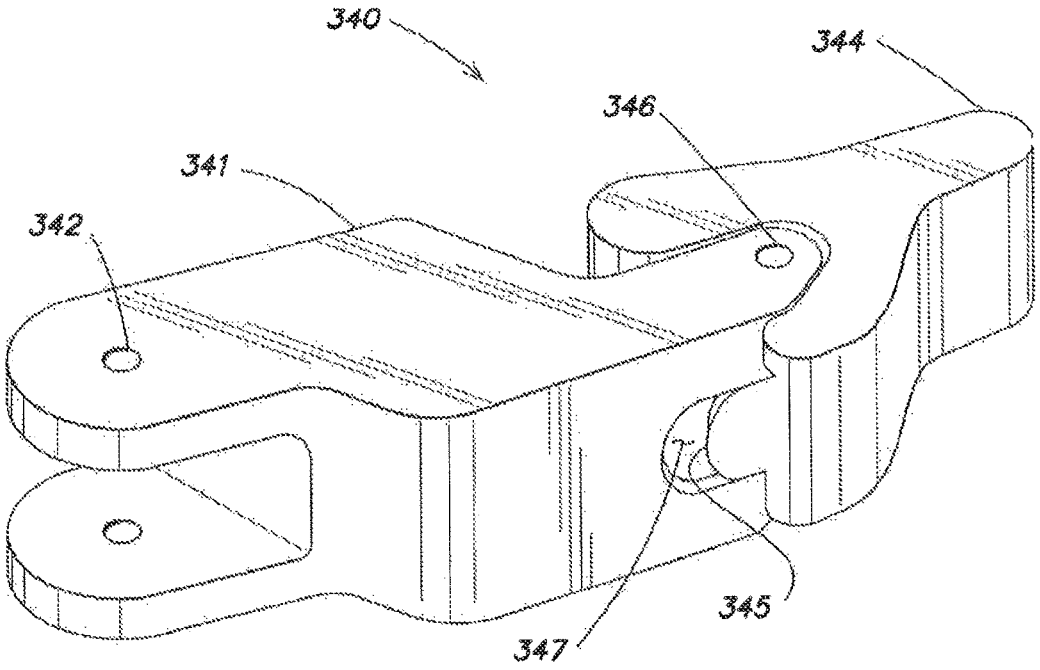
FIG. 4 is a perspective view of a grip of a modular system for mounting firearm accessories, in accordance with another embodiment of the present disclosure.

FIG. 4 illustrates a grip 340 of modular system 100 in accordance with another embodiment of the present disclosure. Grip 340 includes a main body 341 having an aperture 342, a handle 344 pivotably coupled with main body 341 through pin 346, a locking member 345 on handle 344, and a void 347. In this embodiment, grip 140 may be pivotably coupled to connection head 135 of column 130 by insertion of pin 152 through aperture 342 of grip 340 and through hole 132 of connection head 135. When joining member 130 having grip 340 is rotated to an angle sufficient to securely fasten first and second mounting members 110 and 120, locking member 345 may be aligned with blocking member 125. By exerting a force at handle 344 to pivotally rotate grip 340 about pin 152, locking member 345 may be moved towards blocking member 125 and subsequently engaged with blocking member 125, so as to maintain handle 344 at a stationary position. Meanwhile, void 347 may be complimentarily engaged with protrusion 127 of second mounting member 120 to ensure that grip 340 is not free to rotate about an axis of column 130 after locking member 345 is engaged with blocking member 125. In one embodiment, pin 346 may be coupled with an elastic member (not shown) so as to provide a restoration force for handle 344 and to enhance the engagement of locking means 345 and blocking member 125.

In another embodiment, the present disclosure provides a method for attaching a firearm accessory to a firearm. The method includes providing a modular system 100 for mounting firearm accessories, as shown in FIG. 1. Modular system 100 includes a first mounting member 110 capable of receiving a firearm accessory, a second mounting member 120 capable of combining with first mounting member 110, and a joining mechanism 130 for releasably combining first mounting member 110 with second mounting member 120. Joining mechanism 130 includes a column having a substantially cylindrical shape.

The method further comprises attaching first and second mounting members 110 and 120 to mounting site 200 of a firearm, and joining first and second mounting members 110 and 120 using joining mechanism 130 In one embodiment, securely joining the first and second mounting members 110 and 120 comprises rotating joining mechanism 130 about an axis thereof for an angle of about 180 degrees, so as to securely fasten first and second mounting members 110 and 120. When rotating, the axis of mechanism 130 is substantially parallel to the relative motion of first and second mounting members 110 and 120 and substantially perpendicular to the longitudinal direction 250 of the firearm. The method further includes attaching a firearm accessory to first mounting member 110 of modular system 100.

Figure 5:
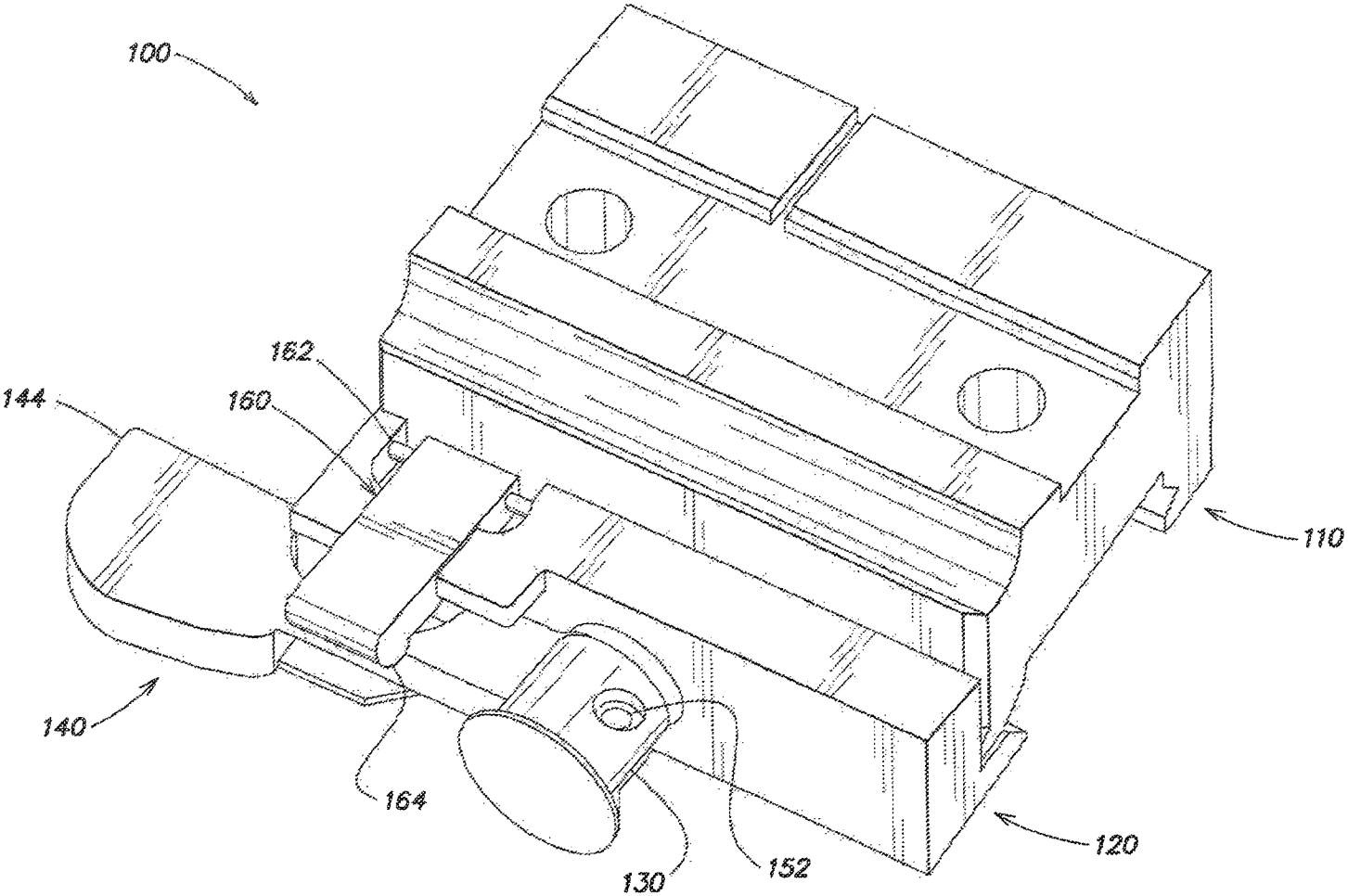
FIG. 5 is a perspective view of a modular system for mounting firearm accessories, in accordance with another embodiment of the present disclosure.
Figure 6:
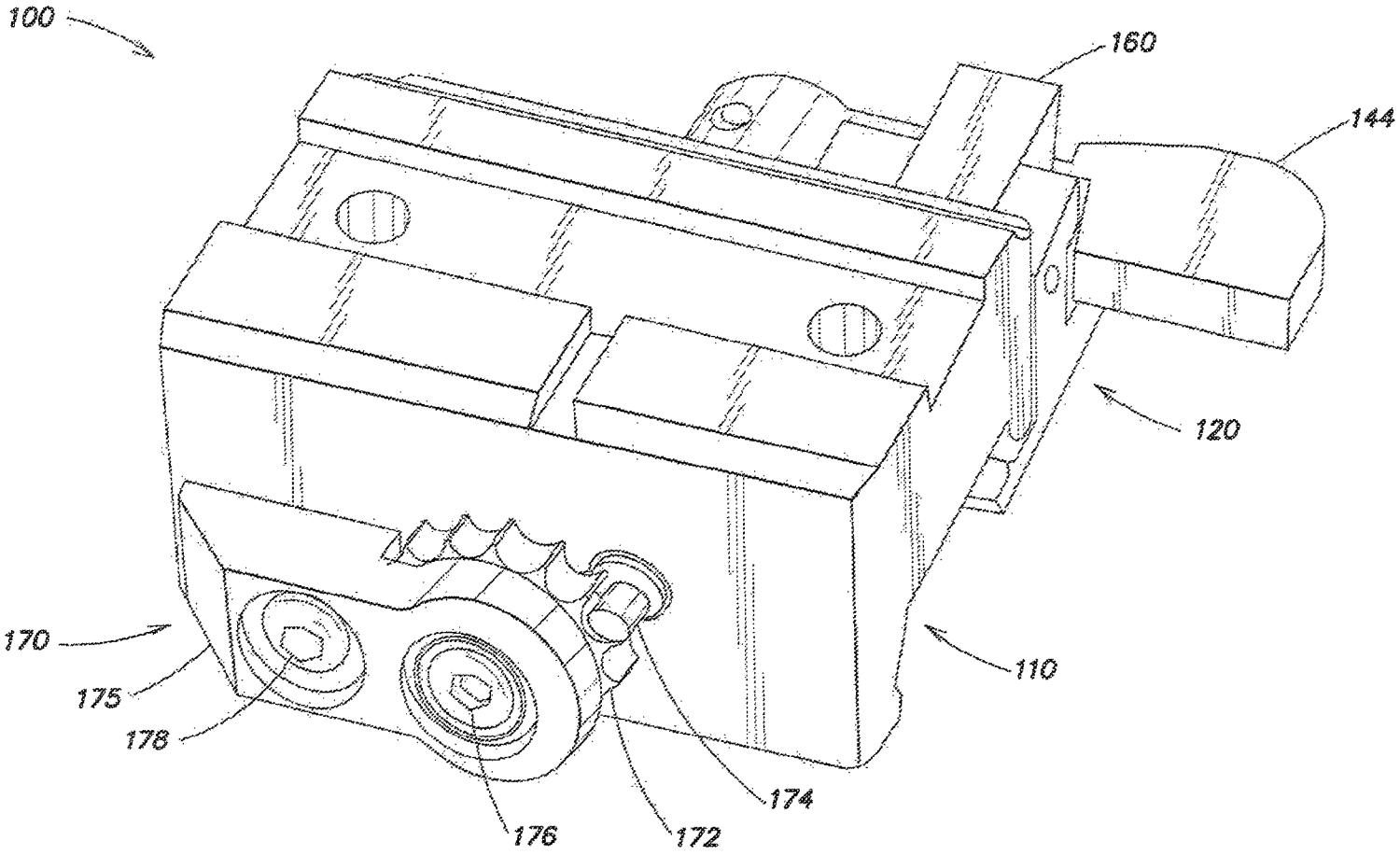
FIG. 6 is another perspective view of the modular system illustrated in FIG. 5.

Referring to FIGS. 5 and 6, there are illustrated perspective views of a modular system 100 for mounting firearm accessories, in accordance with another embodiment of the present disclosure. As shown in FIG. 5, modular system 100 may be constructed and function substantially similar to the other embodiments described herein with an additional adjustment mechanism to fine-tune the spacing between mounting members 110 and 120. As illustrated, system 100 comprises a first mounting member 110 and a second mounting member 120 coupled to first mounting member 110. Second mounting member 120 further comprises a joining mechanism 130 including a column 134 having a substantially cylindrical portion and a grip 140 pivotally coupled to the column 134 through a pin 152. Joining mechanism 130 operably couples first and second mounting members 110 and 120 by insertion of joining mechanism 130 through first and second mounting members 110 and 120.

In one embodiment, a user can place modular system 100 onto mounting site 200, and rotate column 134 of joining mechanism 130 by turning the grip 140. In response to the rotation of joining mechanism 130, first and second mounting members 110 and 120 are brought closer to each other until modular system 100 is securely engaged with mounting site 200. In this embodiment, when joining member 130 is rotated to an angle sufficient to securely engage first and second mounting members 110 and 120 to mounting site 200, grip 140 is aligned with a locking member 160.

In one embodiment, locking member 160 is pivotally coupled to second mounting member 120 through pin 162. In one embodiment, locking member 160 comprises a hook 164 at an end of locking member 160 opposing the pin 162. In one embodiment, grip 140 may be securely engaged with locking member 160 to maintain grip 140 at a stationary position. By exerting a force at a handle 144 of grip 140 to pivotally rotate grip 140 about pin 152, grip 140 may be moved towards locking member 160 and subsequently engaged with locking member 160. In certain embodiments, an elastic member (such as a mechanical spring, not shown) may be coupled to locking member 160, such that locking member 160 is restored to its original position, thereby allowing hook 164 to securely engage a central portion of grip 140.

In certain situations, the dimensions of mounting site 200, or other surface to which system 100 is to be secured, may deviate from standard dimension(s). To accommodate such situations, modular system 100 further comprises a adjustment mechanism 170 coupled to first mounting member 110. Adjustment mechanism 170 enables the relative spacing between mounting members 110 and 120 to be fine-tuned or adjusted prior to being frictionally secured to mounting surface 200 with grip 140.

As shown in FIG. 6, adjustment mechanism 170 comprises a sprocket wheel 172, having a plurality of teeth along the perimeter rim thereof, and a detent device 174 engageable with wheel 172 to lock wheel 172 in accordance with the teeth positions of wheel 172. In one embodiment, the angle between positions of adjacent teeth along the perimeter of wheel 172 may range from approximately 10 degrees to approximately 30 degrees. Wheel 172 is retained adjacent to first mounting member 110 by guide frame 175. Guide frame 175 is secured to first mounting member 110 by fastener 178. In one embodiment, wheel 172 is rotatably coupled to a first end of column 134 oppose grip 140 by a fastener 176, such that the engagement tightness of first and second mounting members 110 and 120 with respect to mounting site 200 can be incrementally adjusted by rotating wheel 172. In one embodiment, wheel 72 has a threaded aperture at the center there of which engages a complementary mating thread on the first end of column 134 so that rotation of wheel 172 causes the relative positions of first mounting member 110 in the second mounting member 122 move continuously depending on the directional rotation of wheel 172. It will be obvious to those reasonably skilled in the arts that other movable coupling configurations of wheel 172, faster 176, and the column 134 may be utilized to achieve equivalent fine-tune adjustment of mounting members 110 and 120 prior to securing a system 100 to another surface.

In one embodiment, detent device 174 may comprise a pin having an end shaped to interact with the teeth of wheel 172. Detent device 174 may be retained within a cylindrical cavity in first mounting member 110. An elastic member, such a coil spring or leaf spring or other biasing mechanism may be positioned within the cylindrical cavity in which detent device 174 is retained within the first mounting member 110 so that detent device 174 can be pushed and retracted into first mounting member 110 and biased against the teeth of wheel 172 once the desired rotational position of wheel 172 is set.

In another embodiment, the present disclosure provides a method for attaching a firearm accessory to a firearm utilizing the system described in FIGS. 5-6. The method includes providing a modular system 100 for mounting firearm accessories, as shown in FIGS. 5-6. Modular system 100 includes a first mounting member 110 capable of receiving a firearm accessory, a second mounting member 120 capable of combining with first mounting member 110, and a joining mechanism 130 for releasably combining first mounting member 110 with second mounting member 120. Joining mechanism 130 includes a column having a substantially cylindrical shape.

The method further comprises attaching first and second mounting members 110 and 120 to mounting site 200 of a firearm, and adjust the relative spacing of first and second mounting members 110 and 120 and securely joining the mounting member together and to the mounting site. In one embodiment, adjust the relative spacing of first and second mounting members 110 and 120 comprises rotating wheel 172 of adjustment mechanism 170 to the position which most closely approximates the dimensions of the mounting site and securing the position of wheel 172 with detent device 174. In one embodiment, securely joining the first and second mounting members 110 and 120 comprises rotating joining mechanism 130 about an axis thereof for an angle of about 180 degrees, so as to securely fasten first and second mounting members 110 and 120. When rotating, the axis of mechanism 130 is substantially parallel to the relative motion of first and second mounting members 110 and 120 and substantially perpendicular to the longitudinal direction 250 of the firearm. The method further includes attaching a firearm accessory to first mounting member 110 of modular system 100.

Figure 7:
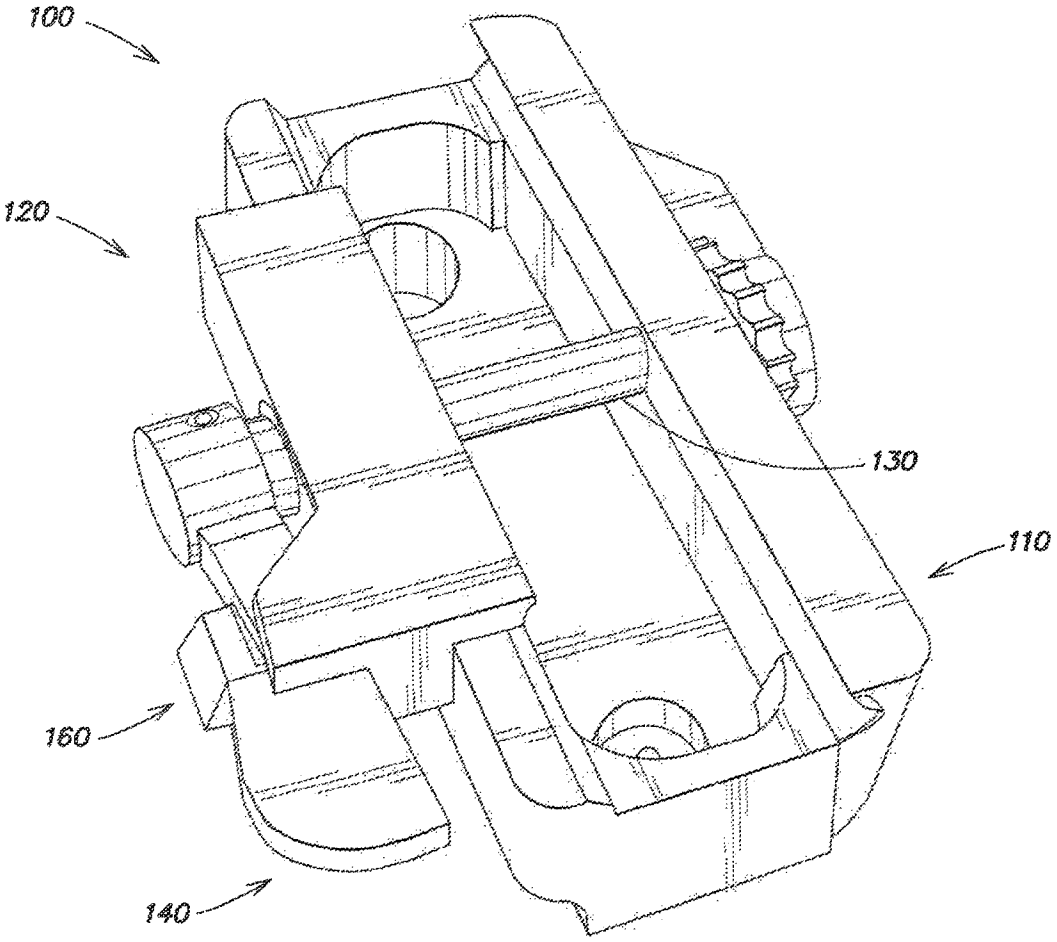
FIG. 7 is a perspective bottom view of a modular system, in accordance with one embodiment of the present disclosure.

FIG. 7 is a perspective bottom view of a modular system 100, in accordance with one embodiment of the present disclosure. As shown in FIG. 7, modular system 100 comprises a first mounting member 110, a second mounting member 120 capable of combining with first mounting member 110, and a joining mechanism 130 for releasably combining first mounting member 110 with second mounting member 120. Modular system 100 further includes a grip 140 for turning joining mechanism to tightly engage first and second mounting members 110 and 120, and a locking member 160 to maintain grip 140 at a stationary position. FIG. 7 shows that first and second mounting members 110 and 120 are securely engaged with grip 140 being maintained in position by locking member 160.

Figure 8:
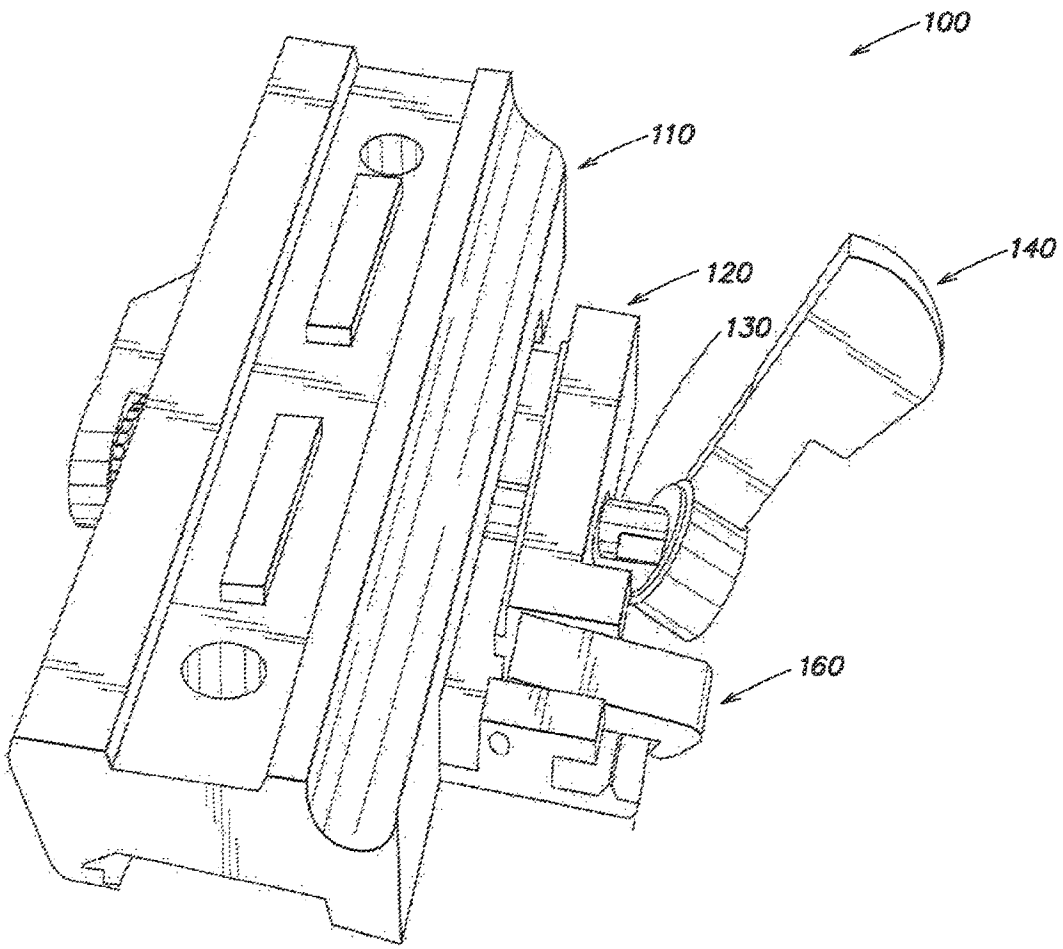
FIG. 8 is a perspective top view of a modular system, in accordance with one embodiment of the present disclosure.

FIG. 8 is a perspective top view of a modular system 100, in accordance with one embodiment of the present disclosure. The modular system 100 of FIG. 8 is the same as that shown in FIG. 7, except that FIG. 8 shows a modular system 100 with first and second mounting members 110 and 120 being released from each other. As shown in FIG. 8, by rotating grip 140 away from locking member 160, second mounting member 120 can be released and thus separated from first mounting member 110.

Figure 9:
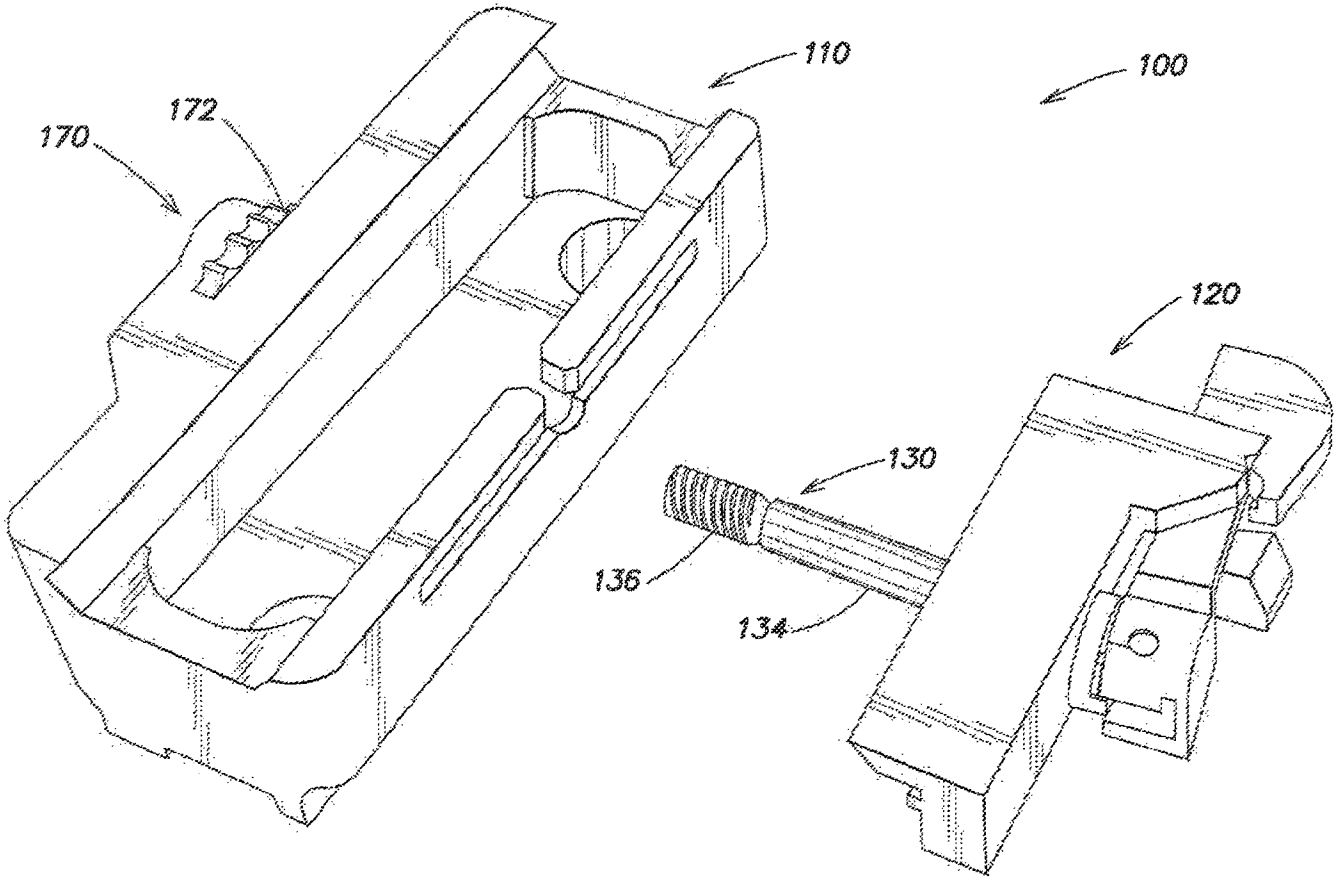
FIG. 9 is a perspective view of a modular system with first and second mounting members disassembled, in accordance with one embodiment of the present disclosure.

FIG. 9 is a perspective view of a modular system 100 with first and second mounting members 110 and 120 disassembled, in accordance with one embodiment of the present disclosure. As shown in FIG. 9, joining mechanism 130 includes a guiding means 136 proximate an end of column 134. In this embodiment, guiding means 136 is threaded and a central portion of sprocket wheel 172 is also threaded to match the threading of guiding means 136. In one embodiment, when components of modular system 100 are properly assembled, the stepwise rotation of sprocket wheel 172 of adjustment mechanism 170 incrementally changes the effective length of column 134 between first and second mounting members 110 and 120 through the the interaction of the complementary threading of guiding means 136 and wheel 172, depending on the direction of rotation of wheel 172. As a result, the engagement tightness of first and second mounting members 110 and 120 with mounting site 200 can be fine tuned and incrementally adjusted by rotating wheel 172. Such adjustment mechanism 170 allows modular system 100 of the present disclosure to fit with mounting sites of various different sizes.

In view of the foregoing, it can be seen that the present disclosure provides a reliable and easy to use pivoting accessory mount for a firearm that serves to allow a firearm accessory to be quickly and reliably moved between engaged and disengaged positions. Utilizing the modular mounting system disclosed herein, these activities can be done manually without the need of tools. Further, modular system 100 can be modified to accommodate a number of different types of firearm accessories.

The modular system for mounting firearm accessories of the present disclosure are described for exemplary and illustrative purposes only. Various modifications and changes may be made to the disclosed embodiments by persons skilled in the art without departing from the scope of the present disclosure as defined in the appended claims.

What is claimed is:

1. A modular system for mounting firearm accessories to a firearm, comprising:

a first mounting member configured to receive a firearm accessory, the first mounting member including a trench extending parallel to a longitudinal axis on a first side of the first mounting member and a channel extending through the first mounting member parallel to a lateral axis, the lateral axis extending orthogonal to the longitudinal axis;

a second mounting member including: a ridge extending parallel to the longitudinal axis, the ridge engaging the trench when the first mounting member is coupled to the second mounting member; and a central cavity extending through the second mounting member parallel to the lateral axis;

a joining mechanism comprising a cylindrical column having a threaded first end and a second end, the second end being opposite the first end, the joining mechanism configured to extend through the channel of the first mounting member and the central cavity of the second mounting member to couple the first mounting member to the second mounting member, thereby attaching the modular system to a mounting site on the firearm;

a grip including a handle, the grip for pivotally coupling the handle to the second end of the cylindrical column adjacent to the second mounting member such that when the first mounting member is coupled with the second mounting member, rotation of the grip around the lateral axis changes an engagement tightness between the first mounting member and the second mounting member;

an adjustment mechanism configured to be rigidly secured, by a first fastener, to the first mounting member on a second side of the first mounting member opposite the first side, the adjustment mechanism including a guide frame housing the first fastener and a second fastener positioned offset from the first fastener, the second fastener configured to secure the threaded first end of the cylindrical column such that when the first mounting member is coupled with the second mounting member, rotation of the joining mechanism changes the engagement tightness between the first mounting member and the second mounting member;

a sprocket wheel comprising perimeter teeth and configured to be retained, by the guide frame, in a position adjacent to the first mounting member and the second fastener, the sprocket wheel having a threaded aperture center for engaging the threaded first end of the cylindrical column such that when the first mounting member is coupled to the second mounting member, rotation of the sprocket wheel changes the engagement tightness between the first mounting member and second mounting member;

a detent device including a pin retained within a cylindrical cavity in the first mounting member, an elastic member biasing the pin such that when the first mounting member is coupled to the second mounting member the pin engages the perimeter teeth of the sprocket wheel to prevent rotation of the sprocket wheel, the elastic member allowing the pin to be pushed into the cavity to allow rotation of the sprocket wheel; and a locking member pivotally attached to the second mounting member, the locking member configured to engage with the grip to maintain the grip in fixed relation to the second mounting member, wherein when the first mounting member is coupled to the second mounting member, the trench of the first mounting member and the ridge of the second mounting member engage to prevent movement of the first mounting member and the second mounting member, with respect to one another, along a third axis orthogonal to both the longitudinal axis and the lateral axis.

2. The system of claim 1, wherein the locking member comprises a hook configured such that when the locking member is engaged with the grip, the hook can engage with a central portion of the grip to further maintain the grip in fixed relation to the second mounting member.

3. The system of claim 1, wherein an angle between the perimeter teeth is between about 10 degrees and about 30 degrees.

4. The system of claim 1, wherein the joining mechanism includes a neck portion proximate to the second end of the cylindrical column, the neck portion having a diameter less than that of the cylindrical column, wherein when the first mounting member is coupled to the second mounting member, the neck portion is positioned within the cavity.

5. The system of claim 4, wherein the second mounting member includes two apertures extending through the second mounting member parallel to the third axis, the apertures extending into the cavity.

6. The system of claim 5, further comprising first and second posts, wherein when the neck portion is positioned within the cavity, the first and second posts are insertable into the two apertures of the second mounting member to narrow the cavity around the neck and engage with the cylindrical column to retain the neck in the cavity.

7. The system of claim 6, wherein:

the joining mechanism includes a helical notch proximate to the threaded first end;

the first mounting mechanism includes an aperture extending through the first mounting mechanism and into the channel parallel to the third axis; and a third post is configured for insertion into the aperture of the first mounting mechanism to engage the helical notch when the first mounting member and the second mounting member are coupled such that when the joining mechanism is rotated, the third post engages the helical notch to change the engagement tightness between the first mounting member and the second mounting member.

8. The system of claim 1, wherein the grip further comprises a main body coupled to the handle via a grip pin, the handle including a central locking member configured for rotation around the grip pin to engage a blocking member on the second mounting mechanism to retain the grip in fixed relation to the second mounting mechanism.

9. The system of claim 8, wherein:

the grip further comprises a void between the central locking member and the main body, the void configured for engagement with a protrusion on the second mounting member to prevent rotation of the grip around the lateral axis, the protrusion extending parallel to the lateral axis; and the main body attaches the grip to the second end of the cylindrical column.

10. A modular system for mounting firearm accessories to a firearm, comprising:

a first mounting member configured to receive a firearm accessory, the first mounting member including a trench extending parallel to a longitudinal axis on a first side of the first mounting member and a channel extending through the first mounting member parallel to a lateral axis, the lateral axis extending orthogonal to the longitudinal axis;

a second mounting member including: a ridge extending parallel to the longitudinal axis, the ridge engaging the trench when the first mounting member is coupled to the second mounting member; and a central cavity extending through the second mounting member parallel to the lateral axis;

a joining mechanism comprising a cylindrical column having a threaded first end and a second end, the second end being opposite the first end, the joining mechanism configured to extend through the channel of the first mounting member and the central cavity of the second mounting member to couple the first mounting member to the second mounting member, thereby attaching the modular system to a mounting site on the firearm;

a grip including a main body coupled to a handle via a grip pin, the main body for pivotally coupling the handle to the second end of the cylindrical column adjacent to the second mounting member such that when the first mounting member is coupled with the second mounting member, rotation of the grip around the lateral axis changes an engagement tightness between the first mounting member and the second mounting member, the grip further including a void between a central locking member of the handle and the main body, the void configured for engagement with a protrusion on the second mounting member to prevent rotation of the grip around the lateral axis, the protrusion extending parallel to the lateral axis;

an adjustment mechanism configured to be rigidly secured, by a first fastener, to the first mounting member on a second side of the first mounting member opposite the first side, the adjustment mechanism including a guide frame housing the first fastener and a second fastener positioned offset from the first fastener, the second fastener configured to secure the threaded first end of the cylindrical column such that when the first mounting member is coupled with the second mounting member, rotation of the joining mechanism changes the engagement tightness between the first mounting member and the second mounting member;

a sprocket wheel comprising perimeter teeth, an angle between the perimeter teeth being between 10 degrees and 30 degrees, the sprocket wheel configured to be retained, by the guide frame, in a position adjacent to the first mounting member and the second fastener, the sprocket wheel having a threaded aperture center for engaging the threaded first end of the cylindrical column such that when the first mounting member is coupled to the second mounting member, rotation of the sprocket wheel changes the engagement tightness between the first mounting member and second mounting member;

a detent device including a pin retained within a cylindrical cavity in the first mounting member, an elastic member biasing the pin such that when the first mounting member is coupled to the second mounting member the pin engages the perimeter teeth of the sprocket wheel to prevent rotation of the sprocket wheel, the elastic member allowing the pin to be pushed into the cavity to allow rotation of the sprocket wheel; and a locking member pivotally attached to the second mounting member, the locking member configured to engage with the grip to maintain the grip at in fixed relation to the second mounting member, the locking member comprising a hook configured such that when the locking member is engaged with the grip, the hook engages with a central portion of the grip to further maintain the grip in fixed relation to the second mounting member, wherein:

when the first mounting member is coupled to the second mounting member, the trench of the first mounting member and the ridge of the second mounting member engage to prevent movement of the first mounting member and the second mounting member, with respect to one another, along a third axis orthogonal to both the longitudinal axis and the lateral axis; and the central locking member is configured for rotation around the grip pin to engage a blocking member on the second mounting mechanism to retain the grip in fixed relation to the second mounting mechanism.

* * * * *